United States Patent [19]

Reinstein et al.

[11] Patent Number: 4,907,424

[45] Date of Patent: Mar. 13, 1990

[54] EARRING WITH REMOVABLE LOWER MEMBER

[76] Inventors: Beverly A. Reinstein; Pamela L. Reinstein, both of 41 Beaumont Dr., Melville, N.Y. 11747

[21] Appl. No.: 295,123

[22] Filed: Jan. 9, 1989

[51] Int. Cl.[4] ..... A44C 7/00

[52] U.S. Cl. ..... 63/12; 63/13; 63/29.1

[58] Field of Search ..... 63/12, 13, 1.1, 14.1, 63/14.2, 14.3, 14.4, 14.5, 14.6, 14.7, 14.8, 29.1

[56] References Cited

U.S. PATENT DOCUMENTS

| | | | |
|---|---|---|---|
| 122,328 | 1/1872 | Northup . | |
| 251,068 | 12/1881 | Russell . | |
| 421,433 | 2/1890 | Rees . | |
| 790,965 | 5/1905 | Lieberfreund . | |
| 2,797,561 | 7/1957 | Vaughn | 63/13 |
| 4,783,974 | 11/1988 | Hernandez | 63/12 X |
| 4,803,852 | 2/1989 | Waldron | 63/13 |

FOREIGN PATENT DOCUMENTS

| | | | |
|---|---|---|---|
| 65910 | 7/1914 | Austria | 63/12 |
| 463806 | 12/1913 | France | 63/13 |

*Primary Examiner*—Laurie K. Cranmer

*Attorney, Agent, or Firm*—Fitch, Even, Tabin & Flannery

[57] ABSTRACT

An earring comprising an upper member for attachment to a pierced ear, and a lower member for removable suspension from the upper member. The lower member is supported by a post on the upper member. In one embodiment, the upper member has an upper post for insertion in a pierced ear, a lower post extending beneath the upper post for supporting the lower member, and a clasp mounted beneath the lower post. The lower member has an opening therein for receiving the lower post. The clasp and lower member preferably cooperate such that the clasp is biased against the lower post when in closed position so as to secure the lower member on the lower post, whereby the lower post also acts as a stop for the clasp to limit pressure on the wearer's earlobe. In a second embodiment, only a single post is provided and the earring is supported on the wearer's ear by a conventional spring-loaded clasp.

6 Claims, 2 Drawing Sheets

EARRING WITH REMOVABLE LOWER MEMBER

BACKGROUND OF THE INVENTION

The invention relates generally to jewelry, and more particularly to a two-piece earring.

One of the problems associated with the design and manufacture of earrings is the provision of means for securing the earring on the earlobe of the wearer so as to minimize the risk of accidental loss, while also enabling convenient attachment and removal of the earring by the wearer. An early example of an attempt to solve this problem is disclosed in U.S. Pat. No. 421,433, which describes a wire for insertion through the opening of a pierced ear, a pivoted locking bar provided with an eye for engaging the ear wire, and a pivoting keeper mounted on the locking bar. Other proposals are shown in U.S. Pat. Nos. 251,068 and 790,965.

Two considerations limit the practicality of some proposed mechanisms. First, the earring must be relatively light, because it is supported entirely by the wearer's earlobe, and accordingly the mechanism should not add greatly to the weight of the earring. Second, the mechanism should be relatively simple. If the mechanism requires a great deal of precision to manufacture or is complex with several moving parts, its cost may make it commercially impractical. It is a general object of the invention to provide a lightweight, reliable mechanism for securely maintaining an earring on the wearer's earlobe, while permitting relatively simple attachment and detachment.

A further object of the invention is to provide an earring having an upper member which is attached directly to the ear, and a lower member which is releasably attachable to the upper member. While such an earring is disclosed in U.S. Pat. No. 2,797,561, the earring disclosed therein relies on two separate mechanisms, one to secure the earring to the wearer's earlobe and the other to secure the detachable lower member to the upper member. It is an object of the invention to provide a single mechanism for achieving both of these functions which is simpler and easier to operate than the mechanisms of U.S. Pat. No. 2,797,561.

SUMMARY OF THE INVENTION

The invention provides an earring comprising an upper member for attachment to the wearer's ear and a lower member for removable suspension from the upper member, wherein the lower member is supported on a post which extends from an inner surface of the upper member, with the post extending through an aperture in the lower member which is sized only slightly larger than the post.

In one embodiment of the invention, the earring is for attachment to a pierced ear, and the upper member comprises a body having an inner surface for abutting engagement with the outer surface of the earlobe, an upper post extending from the inner surface for insertion through an opening in the earlobe, a lower post extending from the inner surface for supporting the lower member, and a clasp mounted beneath the lower post.

The lower member has an upper end with an aperture formed therein to receive the lower post to enable removable suspension of the lower member from the upper member. The opening and post are preferably round so that the lower member may freely pivot relative to the upper member.

The clasp is pivotable between a closed position in which the clasp extends upward to secure the earring on the ear, and an open position in which the clasp extends outward to permit removal of the earring. The clasp includes means at least partially encircling the upper post when the clasp is in its closed position. Detent means are provided to hold the clasp in closed position to avoid accidental opening of the clasp.

The clasp cooperates with the lower post to secure the lower member thereon when the clasp is in its closed position. To this end, the lower post is preferably aligned with the clasp such that the end of the lower post acts as a stop for the clasp, with the clasp being biased against the end of the lower post when in closed position.

In a second embodiment, the earring is adapted for attachment to a non-pierced ear by gripping of the earlobe between the clasp and the inner surface of the body of the upper member.

In both embodiments, the lower post preferably slopes upward from the inner wall in an arcuate configuration so that the lower member has a position of stable equilibrium adjacent the inner surface of the body of the upper member, spaced from the end of the lower post.

DETAILED DESCRIPTION OF PREFERRED EMBODIMENT

Figure 1:
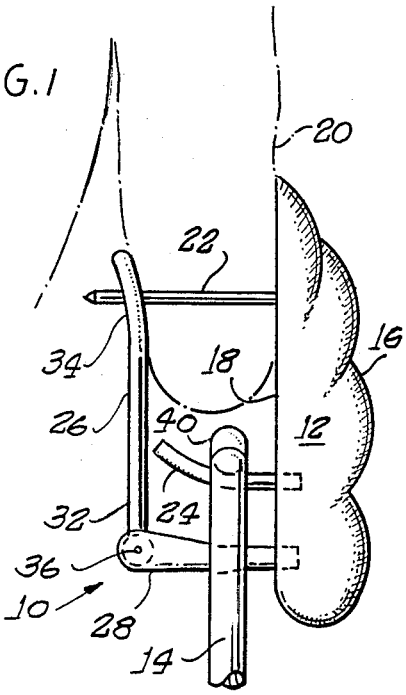
FIG. 1 is a side elevational view, with portions broken away, illustrating an earring in accordance with the invention, in position on a wearer's ear.
Figure 2:
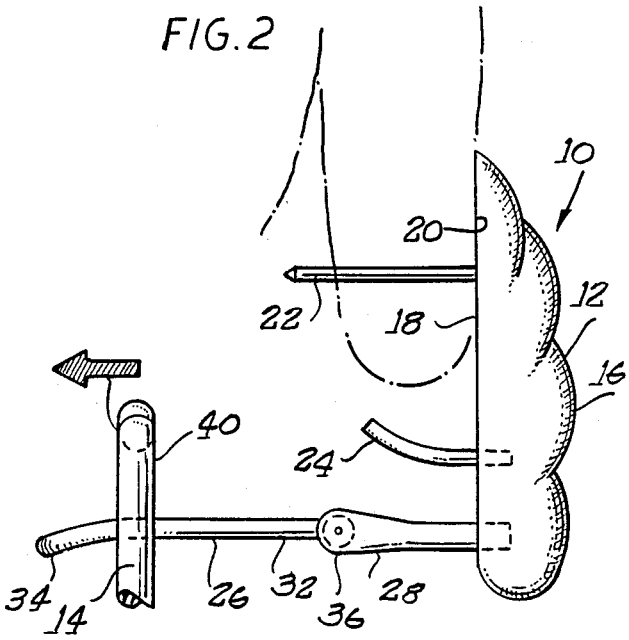
FIG. 2 is an illustration similar to FIG. 1, showing the clasp of the earring in an open position permitting removal of the lower member of the earring.

A first embodiment of the invention is illustrated in FIGS. 1–4, which illustrate an earring 10 having an upper member 12 and a lower member 14. The upper member comprises a body 16 having an inner surface 18 for abutting engagement with the outer surface 20 of the earlobe, an upper post 22 extending from the inner surface for insertion through an opening in the earlobe, and a lower post 24 extending from the inner surface 18 beneath the upper post 22. The lower post 24 provides a support for the lower member 14.

Extending from the inner surface 18 beneath the lower post 24 is a bifurcated support 28 having a pivoted clasp 26 supported on its end. The clasp is pivotable between a closed position, shown in FIGS. 1 and 3, in which the clasp extends upward to secure the earring on the ear, and an open position, shown in FIGS. 2 and 4, in which the clasp extends outward to permit removal of the earring. The clasp 26 includes means defining a loop 34 which encircles the upper post 22 when the clasp is in its closed position.

While the earring is being worn and the clasp 26 is in its closed position as shown in FIG. 1, it is desirable that accidental opening of the clasp be avoided, as this might result in accidental loss of the earring. To this end, detent means 30 maintain the clasp 26 in its closed position. The detent means 30 preferably comprise a pair of facing concave surfaces engaging the ends 32 of the clasp.

The clasp 26 is preferably formed from a length of metal wire, bent so that the end portions 32 are substantially linear and extend parallel to one another, while the remainder defines the loop 34 which encircles the upper post 22 when the clasp is in its closed position. The resiliency of the clasp biases the ends 32 away from one another to cooperate with the detent means 30.

The end portions 32 have aligned apertures formed therein for receiving a hinge pin 36. The hinge pin provides the pivot for the clasp, and is fixedly mounted on the bifurcated support 28, extending generally horizontally through openings therein and being constrained against axial movement relative thereto.

Figure 3:
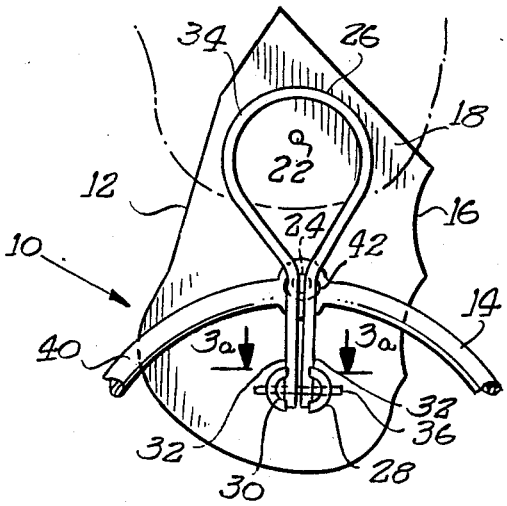
FIG. 3 is a rear elevational view of the earring of FIG. 1, showing the clasp in closed position.
Figure 3A:
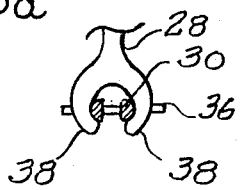
FIG. 3*a* is a fragmentary sectional view taken substantially along line 3*a*–3*a* and looking in the direction of the arrows.
Figure 4:
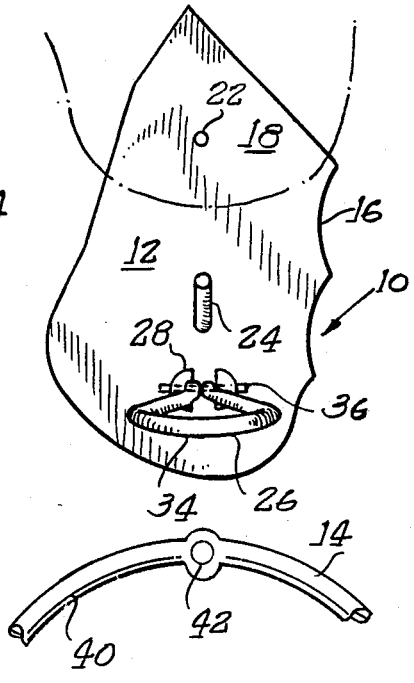
FIG. 4 is a rear elevational view of the earring of FIG. 1, showing the clasp in open position with the lower member removed.

When the clasp is in its closed position, as shown in FIGS. 1 and 3, small forces tending to open the clasp, as might occur normally during wearing of the earring, are insufficient to open the clasp. Any slight outward displacement of the clasp is reversed by the camming action of the detent surfaces on the ends of the clevis 28. However, when it is desired to remove the earring, the clasp may be pivoted, with the detent surfaces camming the ends 32 together as the clasp pivots outward, overcoming the resilient biasing force urging the ends 32 away from one another.

The lower post preferably cooperates with the detent means 30 in defining an equilibrium position for the clasp 26. To this end, when the clasp 26 is in closed position, one or both of its end portions 32 abut the end of the lower post 24. The detent means 30 bias the clasp 26 against the end of the lower post 24. The lower post 24 thus limits the pressure applied to the earlobe by the clasp 26. This enables the detent means 30, in combination with the resilient force of the clasp 26, to provide relatively high closing force, thus facilitating secure maintenance of the clasp in closed position, without transmitting such high compressive stress on the earlobe as might be a source of discomfort for the wearer. The loop 34 of the clasp 26 is preferably spaced from the inner surface 18 by about 3/16 in. in closed position.

The abutting relationship of the clasp 26 and the lower post 24 has a further advantage in that it prevents the lower member 14 from accidentally being removed from the upper member 12. The lower member 14 has an upper end portion 40 with an opening 42 therein for receiving the lower post 24. The opening 42 is preferably circular, as is the exterior of the post 24. The opening 42 preferably has a diameter only slightly greater than that of the post 24 so that the lower member 14 is permitted to pivot freely, but is constrained against other movement prependicular to the post 24.

It is desirable that the upper end portion 40 of the lower member 14 abut the inner surface 18 of the body 16 of the upper member 12 while the earring is worn, in order to provide the desired appearance for the earring, as well as to minimize the risk of loss of the lower member 14. To this end, the lower post is curved upwardly toward its end. Preferably, the lower post is perpendicular to the inner surface 18 at its base, and extends away from the surface 18, through a circular arc of less than 90°, and preferably less than 45°. In the illustrated embodiment, the post extends through an arc of about 30°.

Figure 5:
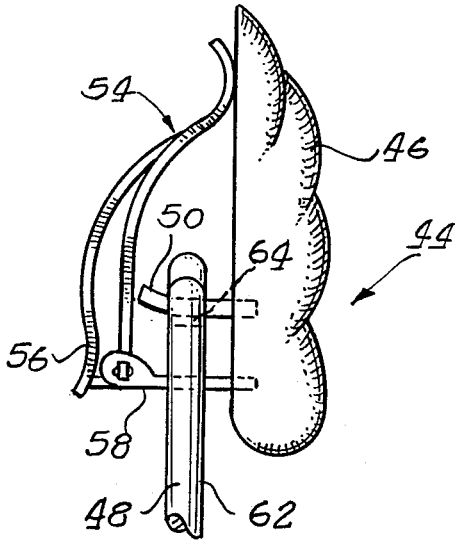
FIG. 5 is a side elevational view of an earring in accordance with a second embodiment of the invention.
Figure 6:
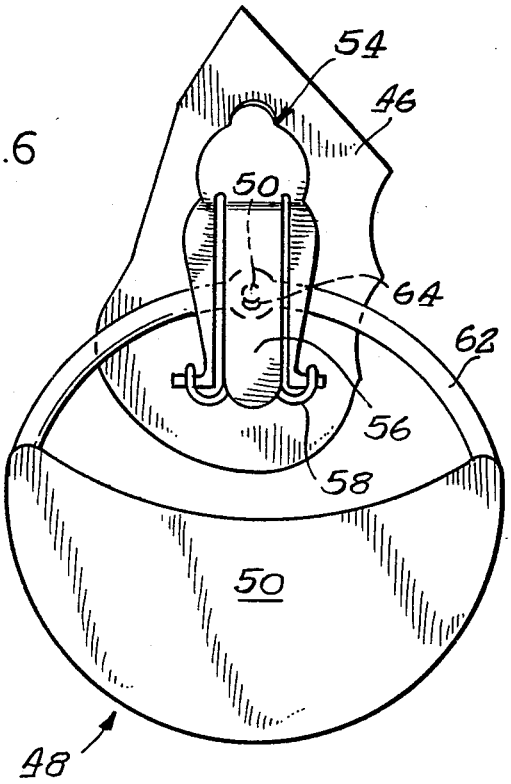
FIG. 6 is a rear elevational view of the earring of FIG. 5.

In accordance with a second embodiment of the invention illustrated in FIGS. 5 and 6, there is provided an earring 44 substantially identical to that of the first embodiment except that it is adapted for attachment to a non-pierced ear. The earring 44 has upper and lower members 46 and 48 respectively, with a post 50 on the upper member 46 supporting the lower member 48, and a clasp 54 pivotably mounted on a support bracket 58 to secure the earring to the wearer's earlobe.

To enable the clasp to provide sufficient gripping force for secure attachment of the earring, the clasp 54 has an integral leaf spring 56 acting against the support bracket 58. The clasp 54 is preferably positioned and configured in such a manner that it does not abut the post 50 when in closed position, but has its inner surface in close proximity to the post 50 so that the lower member cannot be removed.

The lower member 48 has an ornamental body with a bail 62 at its upper end. The bail 62 has an opening 64 to receive the post 50. It may be noted that the bail 62 and body 60 define another opening through which the bracket 58 extends, such that if the opening 64 became disengaged from the post 50, or if the post 50 became disengaged from the upper member 46, the lower member would be held by the bracket 58.

From the foregoing, it should be appreciated that the present invention provides an earring having a novel and improved mechanism for enabling secure attachment of the earring to the wearer's ear, while also enabling secure attachment of a detachable lower member to the upper body of the earring. The earring in accordance with the invention may be provided with several interchangeable lower members of varying design for use in combination with a single upper member.

The invention is not limited to the embodiment described above or to any particular embodiment. The invention is described in the following claims.

What is claimed is:

1. An earring comprising an upper member for attachment to an ear and a lower member for removable suspension from said upper member, said upper member comprising a body having an inner surface for abutting engagement with the outer surface of the earlobe, a post means extending from said inner surface for supporting said lower member, and a clasp mounted on said inner surface beneath said post means;

said lower member having an upper end with an aperture formed therein to receive said post means to enable removable suspension of said lower member from said upper member, said aperture being only slightly larger than said post means;

said clasp being pivotable between a closed position in which said clasp extends upward to secure the earring on the ear, and an open position in which said clasp extends outward to permit removal of the earring;

said upper member further comprising biasing means acting when said clasp is in said closed position to oppose movement of said clasp out of said closed position;

said clasp further including means for cooperating with said post means to secure said lower member thereon so that said lower member cannot be removed from said post means when said clasp is in its closed position;

said clasp having a clamping portion means biased toward a predetermined location on said body of said upper member by said biasing means for clamping a wearer's earlobe thereagainst to support the earring, said post means being spaced beneath said predetermined location to avoid interference between said post means and the earlobe.

2. An earring in accordance with claim 1 wherein said post means is perpendicular to said inner surface at said inner surface, and curves upwardly therefrom so that said lower member has a position of stable equilibrium adjacent said inner surface, while still being readily removable from said post means.

3. An earring comprising an upper member for attachment to a pierced ear and a lower member for removable suspension from said upper member, said upper member comprising a body having an inner surface for abutting engagement with the outer surface of the earlobe, an upper post extending from said inner surface for insertion in an opening in said earlobe, a lower post extending from said inner surface for supporting said lower member, said lower post being disposed beneath said upper post, and a clasp mounted on said inner surface beneath said lower post;

said lower member having an upper end with an aperture formed therein to receive said lower post to enable removable suspension of said lower member from said upper member;

said clasp being pivotable between a closed position in which said clasp extends upward to secure the earring on the ear, and an open position in which said clasp extends outward to permit removal of the earring, said clasp including means at least partially encircling said upper post when said clasp is in its closed position;

said upper member further comprising detent means acting when said clasp is in said closed position to oppose movement of said clasp out of said closed position;

said clasp further including means for cooperating with said lower post to secure said lower member thereon so that said lower member cannot be removed from said lower post when said clasp is in its closed position.

4. An earring in accordance with claim 3 wherein said lower post is aligned with said clasp such that said lower post acts as a stop for said clasp to limit the force applied to the earlobe by said clasp.

5. An earring in accodance with claim 4 wherein said lower post is perpendicular to said inner surface at said inner surface, and extends upwardly therefrom through a circular arc of about 30° so that said lower member has a position of stable equilibrium adjacent said inner surface of said body of said upper member, while still being readily removable from said lower post.

6. An earring comprising an upper member for attachment to an ear and a lower member for removable suspension from said upper member;

said upper member comprising a body having an inner surface for abutting engagement with the outer surface of the earlobe, a first post extending from said inner surface for supporting said lower member, a second post for attaching said earring to a pierced ear, and a clasp mounted on said inner surface beneath said first post;

said lower member having an upper end with an aperture formed therein to receive said first post to enable removable suspension of said lower member from said upper member, said aperture being only slightly larger than said post;

said clasp being pivotable between a closed position in which said clasp extends upward to secure the earring on the ear, and an open position in which said clasp extends outward to permit removal of the earring;

said upper member further comprising biasing means acting when said clasp is in said closed position to oppose movement of said clasp out of said closed position;

said clasp further including means for cooperating with said first post to secure said lower member thereon so that said lower member cannot be removed from said post when said clasp is in its closed position.

* * * * *